US009701449B2

(12) United States Patent
Jacobus

(10) Patent No.: US 9,701,449 B2
(45) Date of Patent: Jul. 11, 2017

(54) BLISTER PACK

(71) Applicant: Spectrum Brands, Inc., Middleton, WI (US)

(72) Inventor: Joseph Henry Jacobus, Janesville, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 61 days.

(21) Appl. No.: 14/167,703

(22) Filed: Jan. 29, 2014

(65) Prior Publication Data

US 2014/0209497 A1 Jul. 31, 2014

Related U.S. Application Data

(60) Provisional application No. 61/758,019, filed on Jan. 29, 2013.

(51) Int. Cl.
*B65D 43/16* (2006.01)
*B65D 43/12* (2006.01)
*B65D 75/36* (2006.01)

(52) U.S. Cl.
CPC ..... *B65D 43/12* (2013.01); *B65D 75/368* (2013.01); *B65D 2575/3227* (2013.01); *B65D 2575/363* (2013.01); *B65D 2585/88* (2013.01)

(58) Field of Classification Search
CPC ..... B65D 43/12; B65D 75/368; B65D 2575/3227; B65D 2575/363; B65D 2575/88; B65D 43/162; B65D 25/205; B65D 2251/105; B65D 75/367; B65D 63/1009
USPC ..... 206/468, 703, 470, 806, 705
See application file for complete search history.

(56) References Cited

U.S. PATENT DOCUMENTS 2,102,094 A * 12/1937 Romig ..... B65D 43/12 220/351
2,935,188 A * 5/1960 Thomas ..... B65D 43/12 206/532
2,941,691 A * 6/1960 Weinberg ..... B65D 43/12 220/345.2
2,985,296 A * 5/1961 Kahn ..... B65D 75/366 206/470
3,035,693 A * 5/1962 Ehrler ..... B65D 73/0092 206/361
3,082,902 A * 3/1963 Kimbrough, Jr. ..... B65D 43/12 206/465
3,157,280 A * 11/1964 Perdue ..... B65D 75/366 206/468
3,162,309 A * 12/1964 Kimbrough, Jr. .. B65D 73/0057 206/468
3,215,333 A * 11/1965 Stelzer ..... B65D 75/366 206/461
3,217,867 A * 11/1965 Harris ..... B65D 75/36 206/468
3,246,747 A * 4/1966 Blish ..... B65D 73/0092 206/462

(Continued)

*Primary Examiner* — King M Chu
(74) *Attorney, Agent, or Firm* — Foley & Lardner LLP

(57) ABSTRACT

A blister pack and method for packaging an item in the blister pack includes a blister card and a blister retained on the card and defines a compartment for retaining the at least one item therein. The blister is slidable relative to the card between a closed position in which the at least one item is inaccessible and an opened position in which the at least one item is accessible for removal from the blister pack.

9 Claims, 7 Drawing Sheets

(56) References Cited

U.S. PATENT DOCUMENTS 3,303,930 A * 2/1967 Hyland ..... B65D 75/366 206/462
3,326,371 A * 6/1967 Riestenberg ..... B65D 75/366 206/464
3,367,491 A * 2/1968 Dunham ..... B65D 75/366 206/468
3,382,972 A * 5/1968 Phipps ..... B65D 75/366 206/468
3,397,770 A * 8/1968 Howard ..... B65D 11/12 206/539
3,414,159 A * 12/1968 Murr ..... B65D 43/12 206/465
3,428,171 A * 2/1969 Blish ..... B65D 75/366 206/461
3,444,995 A * 5/1969 Sanders ..... B65D 85/24 206/382
3,467,248 A * 9/1969 Makowicki ..... B65D 73/0092 206/462
3,530,978 A * 9/1970 Lewandowski ..... B65D 43/12 206/468
3,610,410 A * 10/1971 Seeley ..... B65D 75/366 206/468
3,621,989 A * 11/1971 Pregont ..... B65D 75/326 206/468
3,648,831 A * 3/1972 Arnone ..... B65D 11/12 206/468
3,812,963 A * 5/1974 Zahuranec ..... B65D 75/366 206/468
3,876,133 A * 4/1975 Smith ..... B65D 43/12 220/345.2
3,939,979 A * 2/1976 Neumayer ..... B65D 75/366 206/461
4,062,445 A * 12/1977 Moe ..... B65D 43/12 206/1.5
4,120,400 A * 10/1978 Kotyuk ..... B65D 55/02 206/1.5
4,133,429 A * 1/1979 Kuchenbecker ..... B65D 75/366 206/465
4,192,422 A * 3/1980 Kotyuk ..... A61J 1/035 206/1.5
4,305,504 A * 12/1981 Bredal ..... B65D 11/10 206/467
4,463,893 A * 8/1984 Brunone ..... B65D 5/32 206/468
4,485,920 A * 12/1984 Skylvik ..... B65D 75/366 206/461
4,535,890 A * 8/1985 Artusi ..... A61J 1/16 206/468
4,630,734 A * 12/1986 Severin ..... B65D 5/38 206/102
4,676,377 A * 6/1987 Rainin ..... B01L 3/021 206/468
4,739,883 A * 4/1988 Mohs ..... B65D 73/00 206/461
5,297,679 A * 3/1994 Rondone ..... B65D 73/0092 206/461
5,429,233 A * 7/1995 Juaristi ..... B65D 73/0007 206/461
5,579,910 A * 12/1996 Bennett ..... B65D 75/366 206/362
5,593,036 A * 1/1997 Dyble ..... B65D 75/366 206/348
5,733,147 A * 3/1998 Verstijnen ..... H01R 12/714 235/441
5,735,404 A * 4/1998 Kumakura ..... B65D 75/366 206/459.5
5,878,887 A * 3/1999 Parker ..... B65D 50/06 206/468
5,944,177 A * 8/1999 Nemoto ..... B65D 75/366 206/232
6,050,415 A * 4/2000 Lind ..... B65D 73/0092 206/462
6,244,444 B1 * 6/2001 Jacobus ..... B65D 25/205 206/470
6,308,832 B1 * 10/2001 Pirro ..... B65D 73/0092 206/462
6,349,830 B1 * 2/2002 Lebron ..... B65D 75/36 206/459.5
6,386,368 B1 * 5/2002 Pirro ..... B65D 5/526 206/471
6,419,091 B1 * 7/2002 Gaffney ..... B65D 43/162 206/701
6,427,841 B2 * 8/2002 Wani ..... B65D 75/36 206/471
6,439,390 B1 * 8/2002 Kumakura ..... B65D 75/327 206/469
6,478,158 B2 * 11/2002 Gaffney ..... B65D 43/162 206/704
6,543,209 B1 * 4/2003 Siegel ..... B65D 75/366 206/469
6,668,519 B2 * 12/2003 Richey ..... B65B 5/04 53/139.7
6,986,424 B1 * 1/2006 Morrison ..... B65D 75/368 206/469
7,404,487 B2 * 7/2008 Kumakura ..... B65D 71/08 206/467
7,717,267 B2 * 5/2010 Applebaum ..... B65D 73/0014 206/1.5
8,091,704 B2 * 1/2012 Trigg ..... B65D 75/366 206/467
8,328,016 B2 * 12/2012 Thornton ..... B65D 73/0092 206/465
8,727,120 B2 * 5/2014 Caron ..... B65D 43/20 206/468
2004/0004018 A1 * 1/2004 Nittono ..... B65D 73/0078 206/461
2004/0035746 A1 * 2/2004 Lee ..... B65D 75/366 206/703
2004/0108318 A1 * 6/2004 Wang ..... B65D 43/12 220/345.2
2004/0217116 A1 * 11/2004 Offerman ..... B65D 43/12 220/345.2
2006/0027468 A1 * 2/2006 Berar ..... B65D 83/0805 206/210
2006/0060578 A1 * 3/2006 Church ..... B65D 17/161 220/4.21
2006/0065570 A1 * 3/2006 Martin ..... B65D 75/366 206/703
2008/0118803 A1 * 5/2008 Dekker ..... H01M 8/0228 429/457
2008/0257773 A1 * 10/2008 Gelardi ..... B65D 83/0463 206/462
2010/0243507 A1 * 9/2010 Gelardi ..... B65D 83/0463 206/531
2010/0243509 A1 * 9/2010 Gelardi ..... B65D 75/36 206/536
2010/0294692 A1 * 11/2010 Gelardi ..... B65D 83/04 206/468
2011/0068039 A1 * 3/2011 Sack ..... B65D 75/327 206/531
2011/0155608 A1 * 6/2011 Foster ..... A61B 19/0256 206/466
2011/0229789 A1 * 9/2011 Dekker ..... H01M 8/0254 429/457
2012/0160731 A1 * 6/2012 Aldridge ..... B65D 85/60 206/534
2012/0160862 A1 * 6/2012 Gutierrez ..... B65D 75/327 221/1
2012/0181204 A1 * 7/2012 Bogdziewicz, III ..... B65D 83/0463 206/468

* cited by examiner

BLISTER PACK

CROSS REFERENCE TO RELATED APPLICATION

This application claims priority to Provisional Patent Application Ser. No. 61/758,019, filed on Jan. 29, 2013, which is incorporated herein by reference in its entirety.

FIELD OF THE DISCLOSURE

The present disclosure relates generally to packaging and more particularly to a blister pack.

BACKGROUND OF THE DISCLOSURE

At least some products are packaged in blister packs. Known blister packs include a body coupled to a backing or panel to define a panel therebetween. The compartment is sized and/or configured to contain at least one product. Typically, the body and/or backing is transparent to enable the product to be displayed while the product is sealed and/or stored inside the blister pack.

To access the product stored inside blister packs, the backing is typically torn, punctured, and/or removed from the body. Tearing, puncturing, and/or removing the backing of at least some known blister packs, however, may be time consuming and/or tedious. Moreover, the backings or at least some known blister packs are not resealable and/or closable once the backing is torn, punctured, and/or removed from the body, making organization and/or storage of the other products stored inside the blister pack messy and/or difficult.

SUMMARY OF THE DISCLOSURE

In one aspect, a blister pack is provided for packaging at least one item to be packaged. The blister pack includes a blister card and a blister retained on the card and defining a compartment for retaining the at least one item therein. The blister blister is slidable relative to the card between a closed position in which the at least one item is inaccessible and an opened position in which the at least one item is accessible for removal from the blister pack.

In another aspect, a method is provided for packaging at least one item in a blister pack. The method includes positioning a blister on a blister card, the blister having a compartment in which the at least one item is disposable. The blister is retained on the blister card with the blister being slidably moveable relative to the blister card. The blister is retained on the blister card with the blister compartment substantially closed by the blister card such that the at least one item is inaccessible in a closed position of the blister. A retention member is configured on the blister card to retain the blister against sliding movement relative to the blister to an opened position of the blister in which the at least one item is accessible. The retention member is configurable relative to the blister card to permit sliding movement of the blister relative to the blister card to the opened position of the blister The features, functions, and advantages described herein may be achieved independently in various implementations described in the present disclosure or may be combined in yet other implementations, further details of which may be seen with reference to the following description and drawings.

Figure 1:
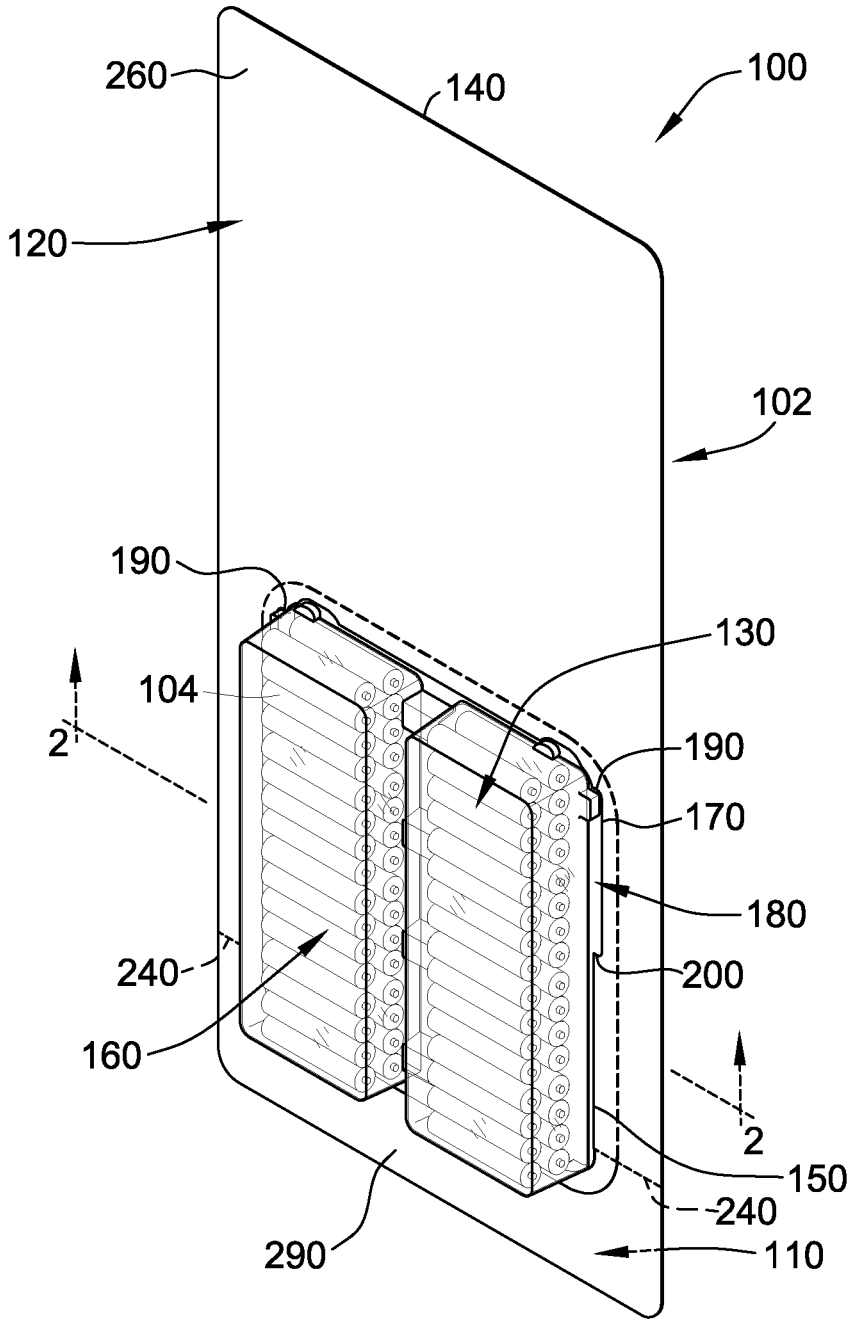
FIG. 1 is a perspective view of one embodiment of a blister pack.

Although specific features of various embodiments may be shown in some drawings and not in others, this is for convenience only. Any feature of any drawing may be referenced and/or claimed in combination with any feature of any other drawing. Corresponding reference characters indicate corresponding parts throughout the drawings.

DETAILED DESCRIPTION OF THE DISCLOSURE

The present disclosure relates generally to packaging and more particularly to a blister pack. For example, in the illustrated embodiment, a blister pack is used for packaging multiple items and, in particular, batteries. It is understood, however, that the blister pack may be used to package items other than batteries and may be used to package a single item.

As used herein, an element or step recited in the singular and preceded with the word "a" or "an" should be understood as not excluding plural elements or steps unless such exclusion is explicitly recited. Moreover, references to an "embodiment" or an "exemplary embodiment" are not intended to be interpreted as excluding the existence of additional embodiments that also incorporate the recited features.

FIG. 1 is a perspective view of one embodiment of a blister pack, generally indicated at 100, comprised of a blister card, generally indicated at 102, and a blister 130 retained on the blister card 102 for packaging and/or retaining at least one item (e.g., batteries 104) to be packaged therein. The illustrated blister card 102 is at least a two-piece card including a rear panel 110 (broadly, a first panel) and a front panel 120 (broadly, a second panel) coupled to the rear panel 110 in opposed relationship therewith.

It is contemplated that in other embodiments, the blister card 102 may be of a single-piece construction, such that it is folded into the desired blister card configuration. In other alternative embodiments, the blister card may comprise a single panel (e.g., a rear panel) and remain within the scope of this invention. For example, in such embodiments, the single panel may comprise a plurality of rails that enable the blister 130 to slide relative to the blister card 102 between a closed position, in which the batteries 104 are inaccessible, and an open position, in which at least one battery 104 is accessible for removal from the blister pack 100 as described in more detail below.

In the exemplary embodiment, the front panel 120 is coupled to the rear panel 110 along an outer edge 140 of the rear panel 110 and/or the front panel 120. In the exemplary embodiment, the outer edges 140 of the rear panel 110 and the front panel 120 are substantially aligned. Alternatively, the rear panel 110 and/or the front panel 120 may have any size and/or configuration that enables the blister pack 100 to function as described herein.

In the exemplary embodiment, the front panel 120 includes a side edge 150 (broadly, a first inner edge) that at least partially defines an opening 160 and a slot edge 170 (broadly, a second inner edge) that at least partially defines at least one slot 180 having an upper end 190 (broadly, a first end) and a lower end 200 (broadly, a second end or stop). In the exemplary embodiment, the slot 180 is an extension of the opening 160. Alternatively, the slot 180 may be defined within the front panel 120 separate from the opening 160.

Figure 2:
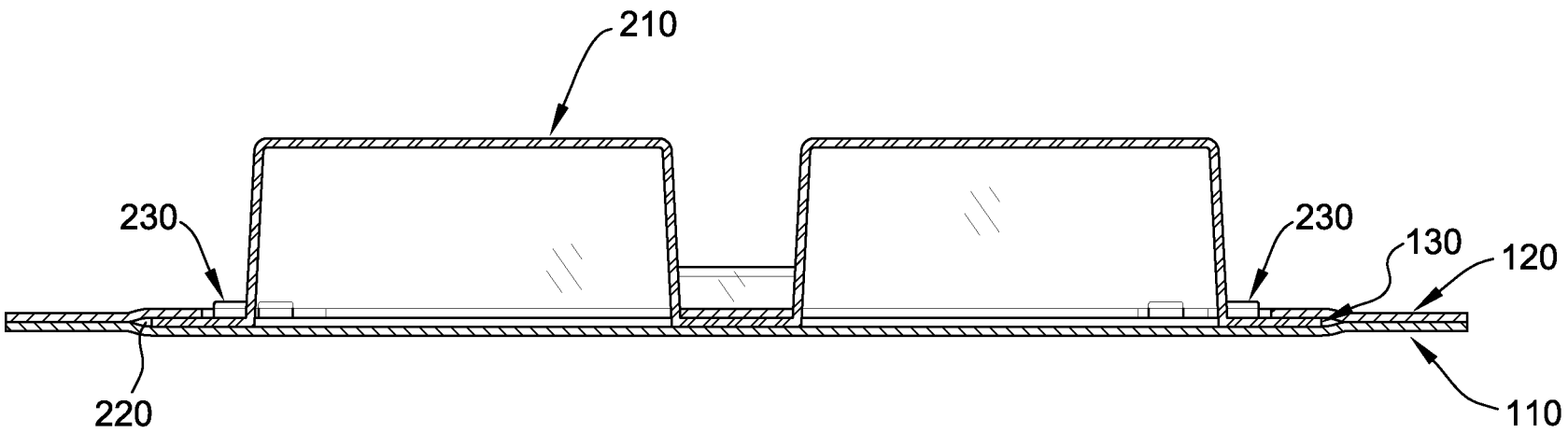
FIG. 2 is a cross-sectional view thereof.

FIG. 2 is a cross-sectional view of the blister pack 100. In the exemplary embodiment, the rear panel 110 and/or the front panel 120 are substantially flat and are fabricated from a paperboard material including, without limitation, linerboard, corrugated fiberboard, and/or solid bleached sulfate. Alternatively, the rear panel 110 and/or the front panel 120 may be fabricated from any material that enables the blister pack 100 to function as described herein.

Figure 3:
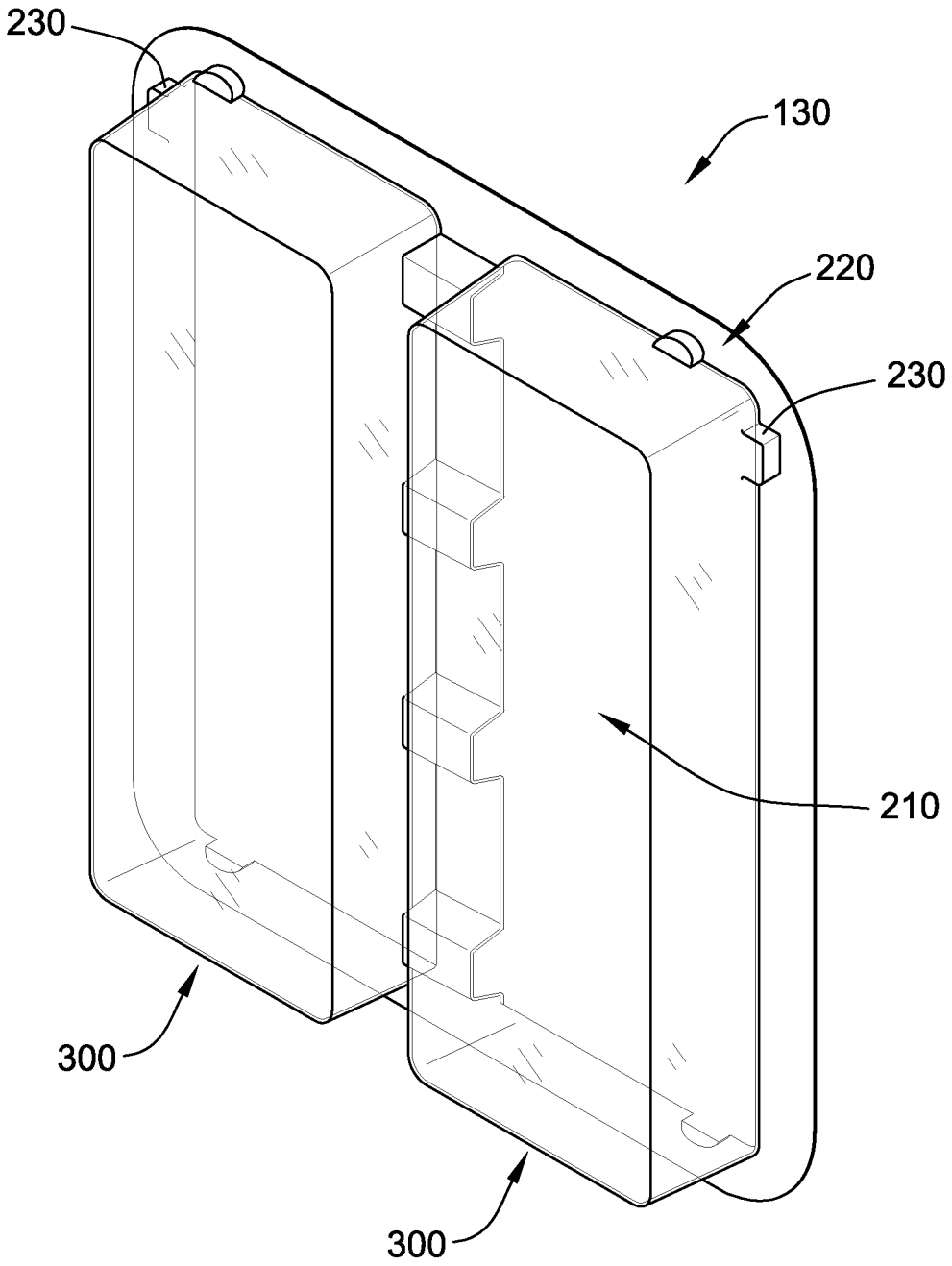
FIG. 3 is a perspective view of a blister of the blister pack of FIG. 1.

FIG. 3 is a perspective view of the blister 130. The illustrated blister 130 includes a body 210, a peripheral flange 220 extending transversely away from the body 210, and at least one protrusion 230 coupled to the flange 220 and/or the body 210. In the exemplary embodiment, the body 210 defines a compartment that is sized to retain and/or store at least one object and/or product therein.

In the exemplary embodiment, the flange 220 is substantially planar and extends within a plane that is between and substantially parallel to the rear panel 110 and/or the front panel 120. As shown in FIG. 2, the flange 220 is substantially flush with the rear panel 110 and/or the front panel 120. In the exemplary embodiment, the blister 130 is not directly coupled or secured to rear panel 110 and/or the front panel 120 and, thus, is free to move independent of the rear panel 110 and the front panel 120.

In the exemplary embodiment, at least a portion of the body 210 extends through the opening 160 (shown in FIG. 1), and at least a portion of the protrusion 230 is positioned within the slot 180 (shown in FIG. 1) such that the protrusion 230 is movable between the upper end 190 (shown in FIG. 1) and the lower end 200 (shown in FIG. 1). That is, in the exemplary embodiment, the blister 130 is slidable relative to the blister card 102 between a closed position (e.g., when the protrusion 230 is at the upper end 190) and an open position (e.g., when the protrusion is at the lower end 200) as described in more detail below.

In the exemplary embodiment, the blister 130 is fabricated from a plastic material that is thermoformed to include the body 210, the flange 220, and/or the protrusion 230. Alternatively, the blister 130 may be fabricated from any material and/or using any method that enables the blister pack 100 to function as described herein.

Figure 4:
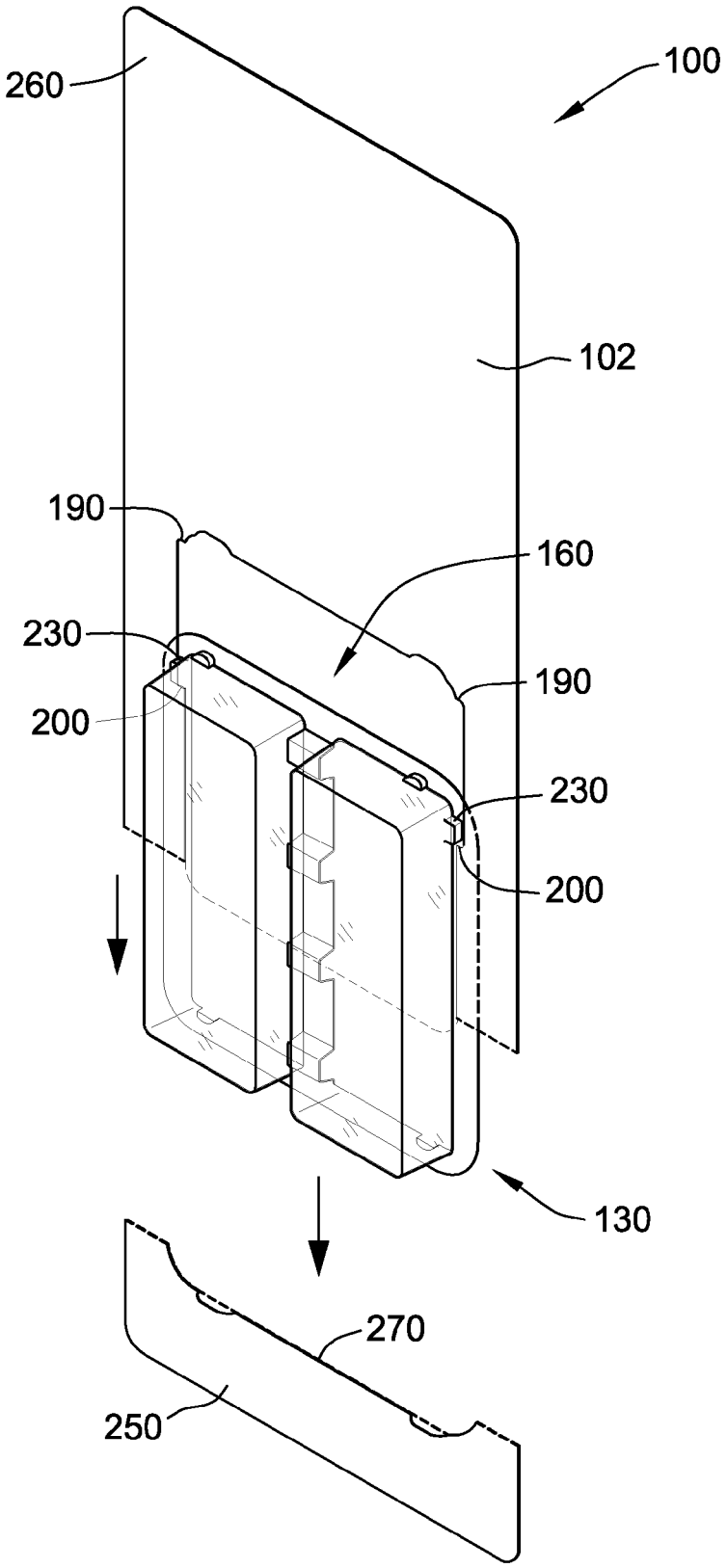
FIG. 4 is a front perspective view of the blister pack of FIG. 1 with a blister thereof moved to an open position.
Figure 5:
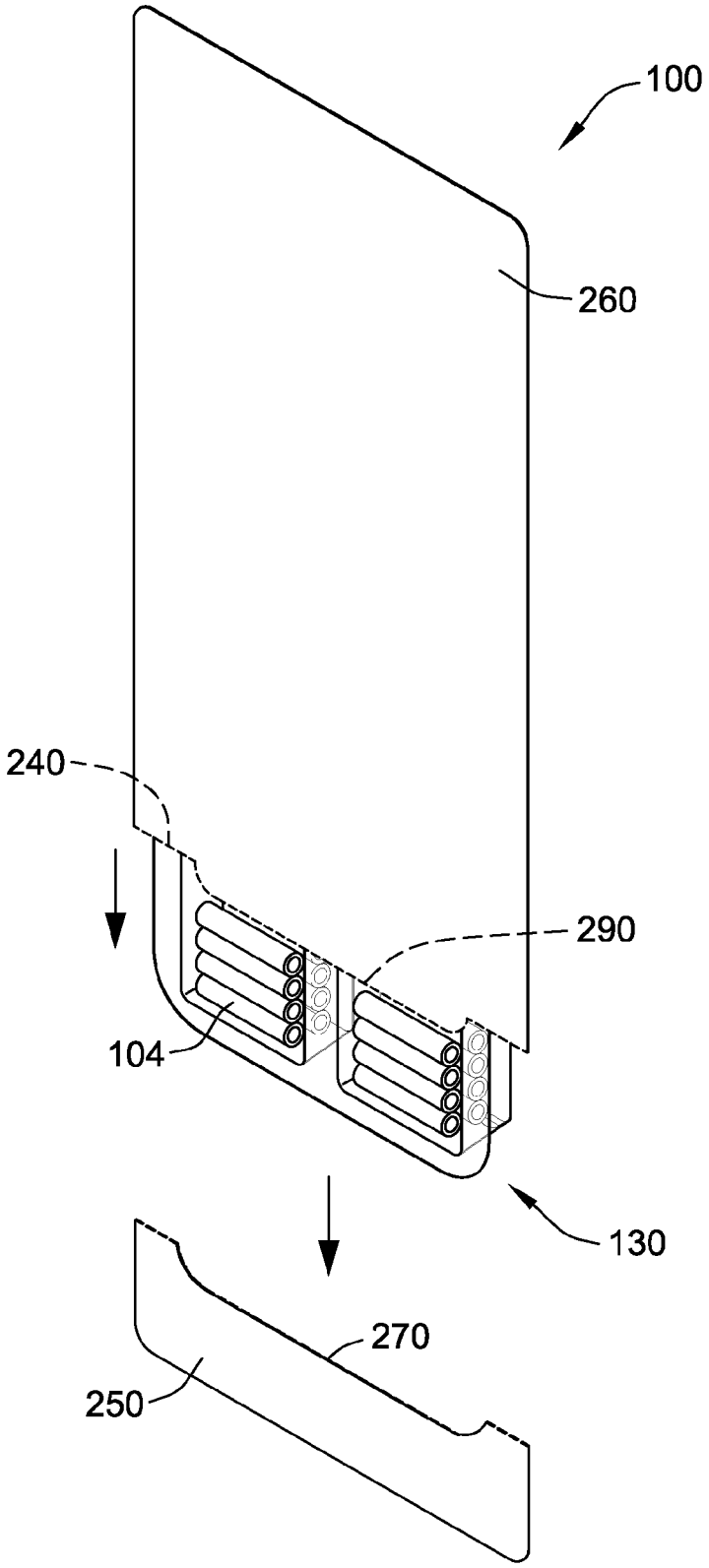
FIG. 5 is a rear perspective view of the blister pack of FIG. 1 with a blister thereof moved to an open position.

FIGS. 4 and 5 are perspective views of the blister pack 100 in the open position. In the exemplary embodiment, a perforation 240 (broadly, a line of weakness) (shown in FIG. 1) extends across the rear panel 110 and the front panel 120 such that a lower portion 250 (broadly, a retention member) of each of the rear panel 110 and the front panel 120 are removable and/or tearable away from a respective upper portion 260 of the rear panel 110 and the front panel 120.

In the exemplary embodiment, the lower portion 250 includes a lower edge 270 (broadly, a third inner edge) of the front panel 120 such that the opening 160 has an open side after the lower portion 250 is removed from the upper portion 260. In the exemplary embodiment, the open side of the opening 160 enables the blister 130 to slide towards the open position. That is, in the exemplary embodiment, the lower portion 250 is configurable between a first configuration in which the blister 130 is retained on the blister card 102 against slidable movement towards the open position, and a second configuration in which the blister 130 is slidable relative to the blister card 102 towards the open position. In the exemplary embodiment, the lower portion 250 does not include the lower end 200 (i.e., the upper portion 260 includes the lower end 200) to facilitate retaining the protrusion 230 within the slot 180 after the lower portion 250 is removed from the upper portion 260.

Figure 6:
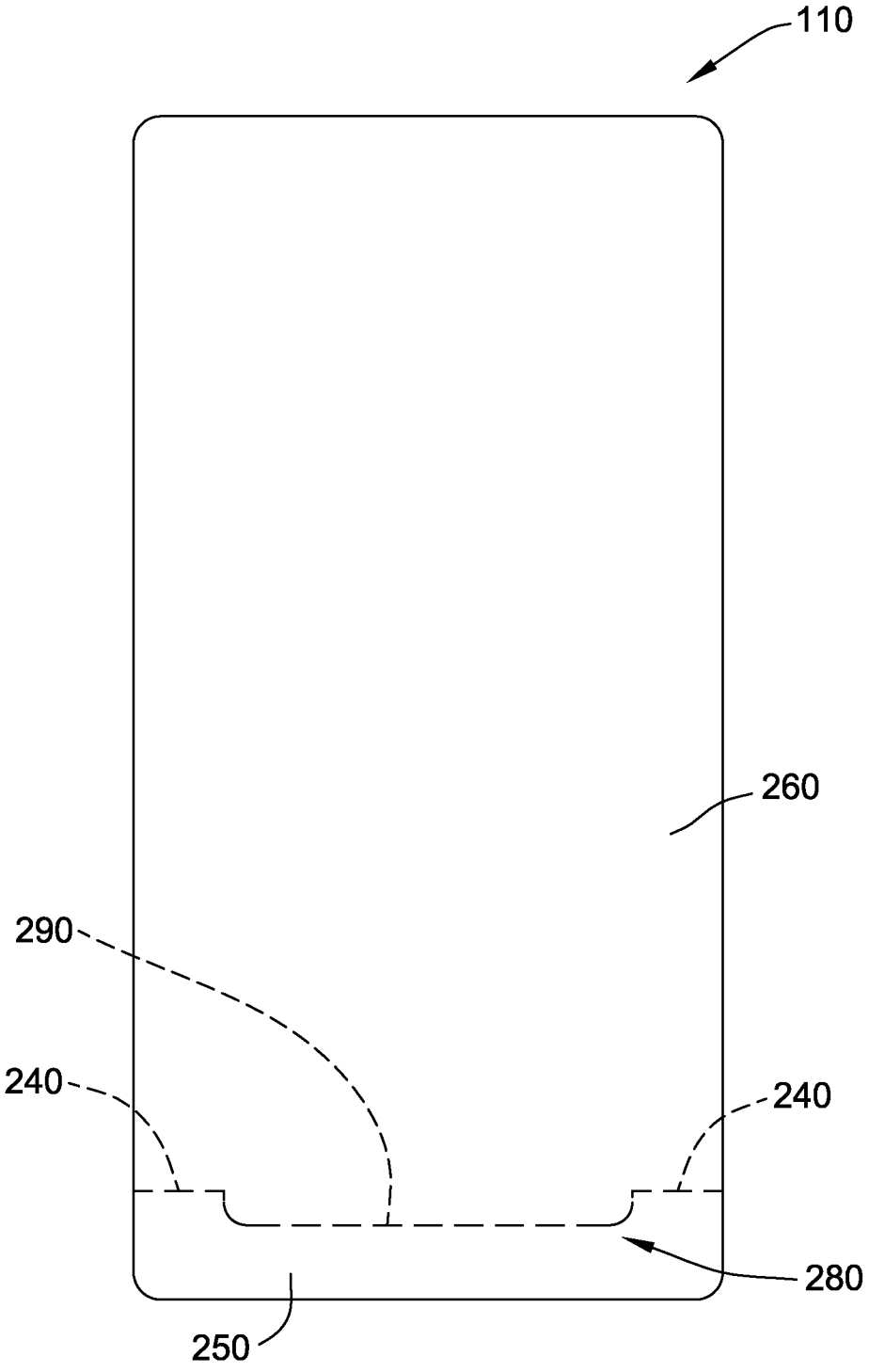
FIG. 6 is a rear view of a rear panel of a blister card of the blister pack of FIG. 1.

FIG. 6 is a rear view of the rear panel 110. In the exemplary embodiment, the perforation 240 of the rear panel 110 is non-linear to facilitate increasing a strength and/or durability of the rear panel 110. More specifically, the perforation 240 of the rear panel 110 includes at least one step 280 that requires a change in force (e.g., direction) to separate the lower potion 250 from the upper portion 260.

The perforation 240 of the rear panel 110 includes a segment 290 that is substantially aligned with and/or extends lower than a lower sidewall 300 (shown in FIG. 3) of the body 210 when the blister 130 is in the closed position to facilitate retaining and/or storing objects within the blister 130. That is, in the exemplary embodiment, the upper portion 260 substantially covers a mouth of the compartment defined by the body 210 to facilitate retaining and/or storing the object within the compartment when the blister 130 is in the closed position. The step 280 and/or the segment 290 may have any shape and/or configuration that enables the perforation 240 to function as described herein.

Figure 7:
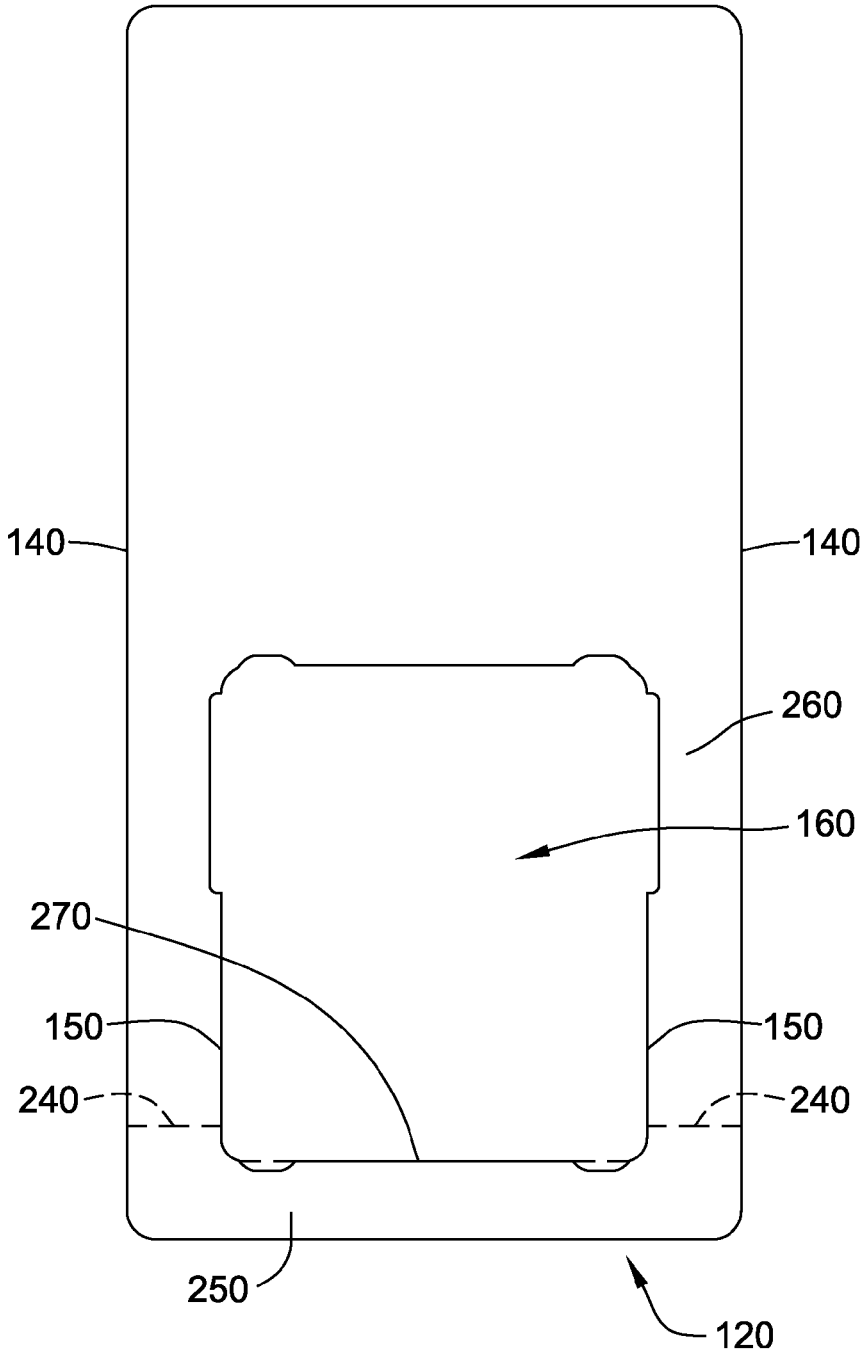
FIG. 7 is a front view of a front panel of a blister card of the blister pack of FIG. 1.

FIG. 7 is a front view of the front panel 120. In the exemplary embodiment, the perforation 240 of the front panel 120 is substantially linear. More specifically, in the exemplary embodiment, the perforation 240 of the front panel 120 is positioned above the lower edge 270 such that the lower portion 250 includes the lower edge 270, and there is a perforation 240 of the front panel 120 on either side of opening 160 that extends between a respective side edge 150 and a respective outer edge 140. The perforation 240 may have any shape and/or configuration that enables the perforation 240 to function as described herein.

To assemble the blister pack 100, the blister 130 is positioned on the rear panel 110 such that at least a portion of the flange 220 is substantially flush with the rear panel 110, and the body 210 and/or the protrusion 230 extend away from the rear panel 110.

The front panel 120 is positioned on the rear panel 110 such that the body 210 extends through the opening 160 and at least a portion of the protrusion 230 is positioned within the slot 180. In the exemplary embodiment, the front panel 120 is coupled to the rear panel 110 with at least a portion of the flange 220 extending between the rear panel 110 and the front panel 120. For example, in the exemplary embodiment, the front panel 120 is heat sealed to the rear panel 110 along an outer edge 140 of the rear panel 110 and/or the front panel 120. Alternatively, the front panel 120 may be coupled to the rear panel 110 using any method and/or mechanism that enables the blister pack 100 to function as described herein.

Before the blister pack 100 is torn along the perforation 240, the upper end 190 keeps the protrusion 230 from moving upward with respect to the rear panel 110 and the front panel 120, and the lower portion 250 keeps the flange 220 from moving downward with respect to the rear panel 110 and the front panel 120. That is, in the exemplary embodiment, the upper end 190 and the lower portion 250 keep and/or retain the blister 130 in a substantially stationary position and, thus, inhibits the blister 130 against sliding longitudinally outward towards the open position.

Once the blister pack 100 is torn along the perforation (i.e., the lower portion 250 is separated from the upper portion 260), the upper end 190 inhibits the protrusion 230 from moving upward with respect to the rear panel 110 and the front panel 120, and the lower end 200 inhibits the protrusion 230 from moving downward with respect to the rear panel 110 and the front panel 120. That is, in the exemplary embodiment, the blister 130 slides between the rear panel 110 and the front panel 120 and is slidable between the closed position, wherein the protrusion 230 is at the upper end 190, and the open position, wherein the protrusion is at the lower end 200.

In the exemplary embodiment, the blister 130 is slidable towards the open position to selectively provide access to the one or more items packaged in the blister pack 100 (e.g., the batteries 104). Moreover, in the exemplary embodiment, the blister 130 is slidable towards the closed position to selectively restrict access to the batteries 104.

The slot 180 of the blister pack 100 is substantially linear to enable the blister 130 to slide substantially linearly between the closed position and the open position. In at least some embodiments, the slot edge 170 may include at least one notch or step (not shown) that facilitates slowing and/or restricting a movement of the protrusion 230 through the slot 180. For example, in at least one embodiment, the slot edge 170 includes a notch adjacent to the upper end 190 that enables keeping and/or retaining the blister 130 in the closed position.

It is contemplated that in other embodiments, the blister pack 100 may have a plurality of blisters 130 that are each independently slidable between a respective closed position and a respective open position. In other alternative embodiments, the blister pack 100 may include additional lines of weakness (not shown) that enable the blister pack 100 to be separated into a plurality of sub-blister packs. For example, in at least one embodiment, the blister pack 100 includes two blister packs 130 and a line of weakness extending between the blister packs 130 that enables the blister pack 100 to be separated into two sub-blister packs. Each sub-blister pack functions or is configured to function substantially similarly to the blister pack 100. The blister pack 100 may include any number of sub-blister packs and lines of weakness that enables the blister pack 100 to function as described herein.

The present disclosure relates generally to packaging and more particularly to a blister pack. The embodiments described herein are configured to slide open to provide access to an object stored within the blister pack without dumping the other objects stored within the blister pack.

When introducing elements of the present disclosure or the exemplary embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the disclosure, it is intended that all matter contained in the above description or shown in the accompanying drawings shall be interpreted as illustrative and not in a limiting sense.

What is claimed is:

1. A blister pack for packaging batteries, comprising:

a plurality of batteries;

a blister card comprising a first portion and a retention member, wherein the blister card is fabricated from a paperboard material; and a blister retained on the blister card, the blister comprising a body defining a compartment for retaining the batteries therein, wherein the compartment has a mouth defined by the body, said blister being slidable relative to the blister card between a closed position in which the mouth is substantially covered so that the batteries are inaccessible and an opened position in which the mouth is exposed below the first portion so that at least one battery is accessible for removal through the mouth, wherein the blister further comprises a stop for stopping the blister in the opened position and inhibiting the blister from separating from the first portion of the blister card upon sliding movement of the blister to the opened position;

wherein in a first configuration, the retention member is attached to the first portion of the blister card so that the blister is retained on the blister card against slidable movement from the closed position to the opened position;

wherein in a second configuration, the retention member is permanently removed from the first portion of the blister card so that the blister is slidable relative to the first portion of the blister card to the opened position; and wherein the blister card includes at least one line of weakness separating the first portion of the blister card and the retention member along which the retention member is tearable away from the first portion of the blister card to permanently remove the retention member from the first portion of the blister card to define the second configuration of the retention member.

2. A blister pack in accordance with claim 1 wherein the line of weakness is other than straight along its entire length.

3. A blister pack in accordance with claim 1 wherein the blister card and the blister are configured relative to each other such that upon removal of the retention member from the first portion of the blister card the at least battery in the blister remains inaccessible in the closed position of the blister.

4. A blister pack in accordance with claim 1 wherein the blister card comprises a first panel and a second panel in opposed relationship with the first panel, the blister being disposed at least in part between the first and second panels without being secured thereto such that the blister is slidable relative to the first and second panels.

5. A blister pack in accordance with claim 4 wherein the second panel has an opening therein, a portion of the blister projecting through said opening in the closed position of the blister.

6. A blister pack in accordance with claim 4 wherein the blister comprises a flange extending transversely outward of the body, the flange being disposed between the first and second panels without being secured thereto.

7. A blister pack in accordance with claim 1 wherein the blister includes a protrusion, the first portion of the blister card engaging the protrusion upon movement of the blister to the opened position to inhibit further movement of the blister beyond the opened position.

8. A blister pack in accordance with claim 1 wherein the blister comprises a first blister defining a first compartment and a second blister retained on the blister card and defining a second compartment for retaining at least one battery therein, said second blister being slidable relative to the blister card and relative to the first blister between a closed position in which the at least one battery is inaccessible and an opened position in which the at least one battery is accessible for removal from the blister pack.

9. A blister pack in accordance with claim 1, wherein the blister card further comprises an opening;

wherein the first portion includes a first slot having a first upper end and a first lower end;

wherein the first portion includes a second slot having a second upper end and a second lower end;

wherein the slots are extensions of the opening;

wherein at least a portion of the body extends through the opening, wherein stop comprises a first stop and the blister further comprises a second stop;

wherein at least a portion of the first stop is positioned within the first slot for movement between the first upper end and the first lower end;

wherein at least a portion of the second stop positioned within the second slot for movement between the second upper end and the second lower end;

wherein in the closed position, the stops are located at the upper ends of the slots; and wherein in the opened position, the stops are located at the lower ends of the slots.

* * * * *